United States Patent [19]

Sartor

[11] 4,282,819

[45] Aug. 11, 1981

[54] ADJUSTMENT DEVICE IN A SEWING MACHINE

[75] Inventor: Friedhelm Sartor, Bielefeld, Fed. Rep. of Germany

[73] Assignee: Kochs Adler AG, Bielefeld, Fed. Rep. of Germany

[21] Appl. No.: 174,448

[22] Filed: Aug. 1, 1980

[30] Foreign Application Priority Data

Mar. 25, 1980 [DE] Fed. Rep. of Germany ..... 3011368

[51] Int. Cl.[3] ..... D05B 21/00

[52] U.S. Cl. ..... 112/121.12; 112/303

[58] Field of Search ..... 112/121.12, 121.15, 112/121.11, 121.29, 308, 309, 220, 303

[56] References Cited

U.S. PATENT DOCUMENTS

| | | | |
|---|---|---|---|
| 2,410,679 | 11/1946 | Pikul | 112/159 |
| 2,495,069 | 1/1950 | McCann | 112/159 X |
| 3,983,825 | 10/1976 | Dobner et al. | 112/121.12 |
| 4,157,686 | 6/1979 | Hager et al. | 112/121.12 |
| 4,160,423 | 7/1979 | Scholl et al. | 112/121.12 |

*Primary Examiner*—H. Hampton Hunter
*Attorney, Agent, or Firm*—Max Fogiel

[57] ABSTRACT

A sewing machine for producing a stitch pattern according to a predetermined program, in which a workpiece receiving device is driven by a linkage cooperating with a rotating control cam. An adjustment device makes it possible to affect portions of the stitch contour with respect to their relative position. The adjustment device has elements interposed between the control cam and the drive shaft for allowing a lateral displacement of the cam relatively to the drive shaft. The amount and the angular position of lateral adjustment may be achieved without rotating the cam and/or the drive shaft.

7 Claims, 9 Drawing Figures

Fig. 3
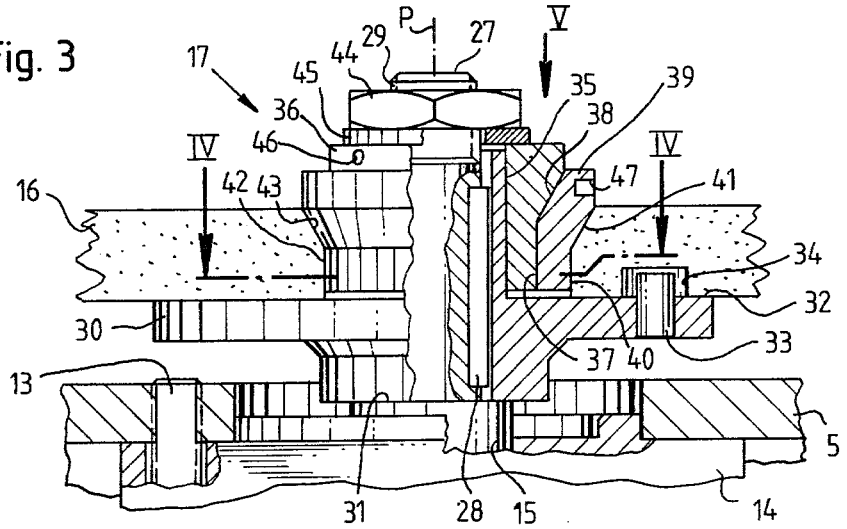
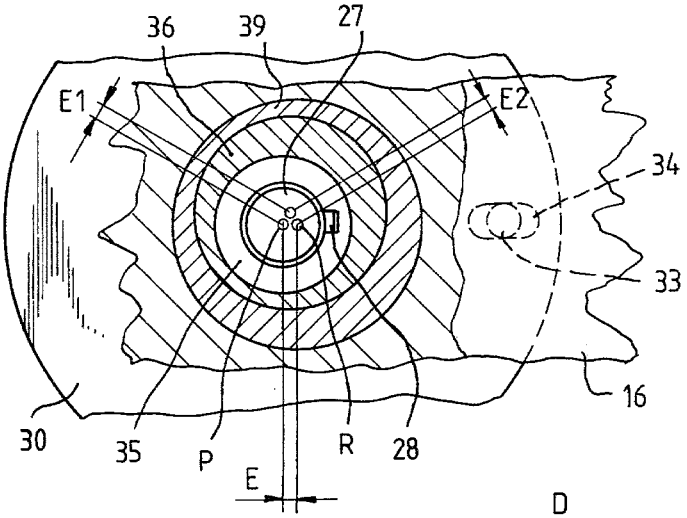
Fig. 4
Fig. 5
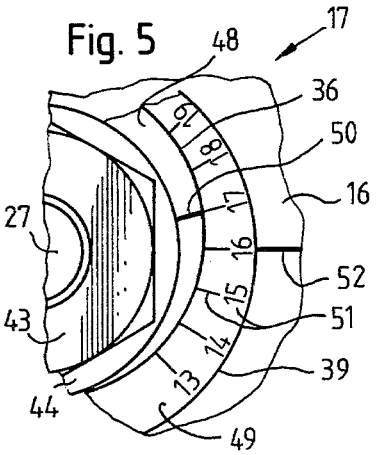
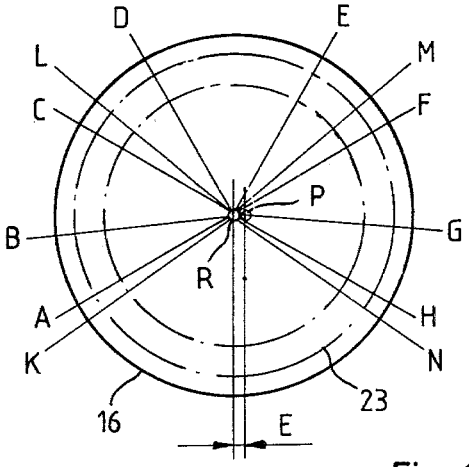
Fig. 6

ADJUSTMENT DEVICE IN A SEWING MACHINE

BACKGROUND OF THE INVENTION

This invention relates in general to a sewing machine for producing a stitch contour in a workpiece according to a predetermined program. A movably arranged workpiece receiving device is controlled with respect to the needle by means of a linkage cooperating with a control cam. In particular, a new device mounts adjustably the control cam to affect portions of the stitch contour with respect to their relative position.

Generally it is known to adjustably mount the control cam of a sewing machine of the aforementioned type, in order to synchronize the feed movement of the workpiece receiving device in relation to the stitch forming elements.

In U.S. Pat. No. 2,495,069 there is illustrated such a sewing machine, in which the control cam is mounted by a device to allow an angular adjustment. From U.S. Pat. No. 2,410,679 there is known a hub connection provided with a device to allow an angular fine adjustment, in which a hub may be adjusted in relation to a shaft by set screws.

Moreover, in U.S. Pat. No. 4,073,252 there is illustrated a sewing machine of the kind described above, for stitching a pocket to a workpiece. In contrast to the aforesaid sewing machines there are produced here stitch contours of a relative large size and which are fixed in their geometric configuration. Due to the limitation of the size of the control cam, such large stitch contours are essentially achieved by applying a linkage installed with a large ratio for converting the drive movements of the cam to the required movements of the workpiece holder, according to the stitch configuration in relation to the needle. As further described, the clamping plate moves the workpiece including the pocket on a stationary base plate by which forces of friction are induced into the control system depending on the material of the workpiece. Furthermore, a shifting at the workpiece and within the layers is caused by the continuous workpiece feeding movements regardless of the needle penetrating the material. Due to these circumstances, the geometry of the stitch configuration is negatively affected. Considering additionally the facts, that the linkage shows a different mechanical stiffness depending on the direction of the feed, it becomes quite obvious, that such influences cannot be taken in account when determining the cam data.

In the process of attaching a pocket to a workpiece by means of a double U-shaped stitch pattern, the aforesaid described problem of geometric deformation causes unequal distances between the individual stitch portions, and injures the appearance of the work. This is most important, if the stitch pattern is emphasized by using a specially colored thread for decorative purposes.

In practice, it has been shown that an exactly computed control cam of such type of sewing machine, does not necessarily furnish the desired quality with respect to the geometric configuration of a sewn pattern at the first attempt. Since there are no possibilities of adjustment, a corrected control cam must be consequently produced in order to compensate the above-described influences. Such an experimental method for producing the control cam is time-consuming and expensive. It is furthermore connected with significant problems when providing a sewing machine already in the field, with another control cam in order to produce a different stitch pattern, as the described influences depending on the material to be processed and the geometry of the stitch pattern, may be judged only after the sewing process.

Accordingly, it is the main object of the present invention to install in a cam controlled linkage of a sewing machine an adjustment device which makes it possible to adjust portions of the stitch pattern in their geometric arrangement.

It is a further object of the present invention to eliminate the experimental procedure of producing a control cam in order to reduce time and costs.

A still further object of the present invention is to create an adjustment device which makes it possible to supply control cams for producing different stitch patterns with sewing machines that are already in the field.

Another object of the present invention is to make the adjustment device of the aforesaid character a part of the sewing machine, so as not to increase the costs of the pattern-depending control cam.

Still another object of the present invention is to provide a device of the aforegoing character which is simple in construction and reliable in operation.

SUMMARY OF THE INVENTION

The objects of the present invention are achieved by providing a control cam adjustment device allowing a lateral displacement of the control cam with respect to the axis about which the cam rotates. Due to this principle of adjustment, the effective radii of sections of the control cam are displaced relative to each other.

The provision of two eccentrical rings arranged on a hub and interposed between the hub and the cam allows adjustment of both, lateral displacement as well as the direction of the lateral displacement of the cam without the necessity to either rotate the cam or to rotate the shaft while carrying out the adjustment procedure. By dimensioning both eccentrical rings with an equal amount of eccentricity, an adjustment is achieved within the limits of zero and twice the amount of eccentricity.

The arrangement of conical portions at the interposed eccentric rings and the bore of the control cam allows elimination of any play within the control cam adjustment device, and furthermore assures an undesired coming off adjustment of the eccentric rings.

The installation of adjustment marks at the elements of the adjustment device and the cam assures easy refinding of a once experienced adjustment, which is important when different styles of patterns are produced alternatively.

The arrangement of a pin cooperating with the recess in the plane surface of the control cam allows liberating the adjustment device from any torque-transmitting function and also forms a positive drive connection between the shaft and the control cam.

Other objects, advantages and features of the present invention will appear from the detailed description of the preferred embodiment, which will now be explained in conjunction with the accompanying drawings.

BRIEF DESCRIPTION OF THE DRAWINGS

FIG. 3 shows the novel control cam adjustment device in a sectional view taken along line III—III of FIG. 1;

FIG. 4 is a top plan view of the control cam adjustment device taken along line IV—IV of FIG. 3;

FIG. 5 is a top plan view of the partially illustrated control cam adjustment device in the direction of the arrow V in FIG. 3;

FIG. 6 is a top plan view of a control cam illustrated with an angular graduation, with, however, the mounting bore omitted;

DESCRIPTION OF THE PREFERRED EMBODIMENT

Figure 1:
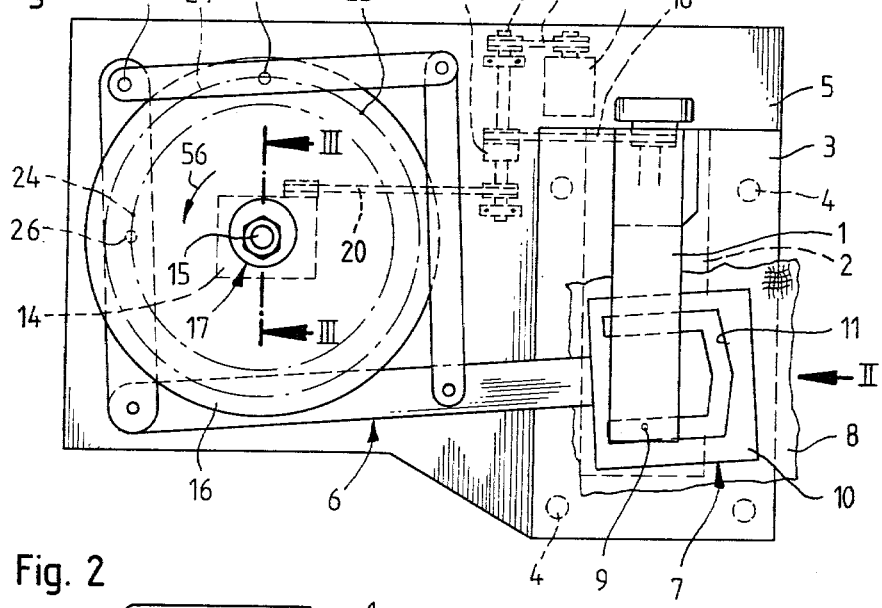
FIG. 1 is a top plan view of a sewing machine including a workpiece receiving device which is guided by a control cam via a linkage.
Figure 2:
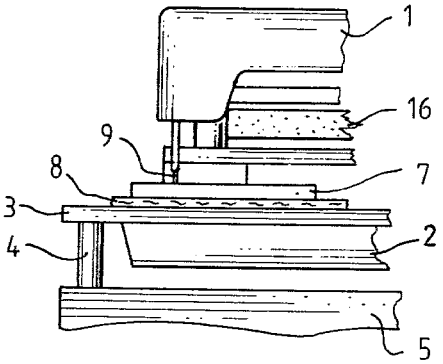
FIG. 2 is a partial front plan view of the sewing machine in the direction of the arrow II in FIG. 1.

Referring to FIG. 1, there is shown a sewing machine having a sewing head 1, the base plate 2 of which is connected to a plate 3 mounted by posts 4 to a frame 5. To the plate 3 there is displaceably supported a workpiece receiving device 7 by a linkage 6 for moving a workpiece 8 along a needle 9 of the sewing head 1 according to a predetermined seam contour. The workpiece receiving device 7 substantially consists of a pressure plate 10 lowerable upon the base plate 2 by means of actuating elements (not shown). The pressure plate 10 is provided with a slot 11 which corresponds to the U-shaped seam contour and which enables the needle 9 to penetrate the workpiece 8. The linkage 6 is journaled at a pivot 12 located at the frame 5, which also receives a gear 14 secured thereto by screws 13 (FIG. 3). The gear 14 has a vertical shaft 15 provided with an adjustment device 17 receiving a control cam 16. An intermediate shaft 19 pivoted within the frame 5 is drivingly connected to a motor 22 by means of a belt drive 21. The shaft 19 is connected via a clutch 18' and a belt drive 18 to the sewing head 1, and furthermore to the gear 14 by means of a belt drive 20. The control cam 16 is formed at its front surfaces with grooves 23, 24 cooperating with cam followers 25, 26 of the linkage 6. The vertical shaft 15 (FIG. 3) is provided with a reduced part 27 having a thread 29 carrying a key 28. The reduced part 27 receives a flange 30 rotatably secured by the key 28 and axially arrested at its lower part by resting against a shoulder 31 of the shaft 15. The control cam 16 is received on a front surface 32 of the flange 30 and secured against rotation by a pin 33 located in the flange 30 and reaching in a recess 34 of the control cam 16. Furthermore, the flange 30 is formed with a hub 35 adjustably receiving a first ring 36 which is provided with a cylindrical part 37 and a first conical part 38, both arranged with an eccentricity E 1 related to the inner bore which is not specified (FIG. 3). The cylindrical part 37 and the first conical part 38 serve for receiving a correspondingly formed second ring 39, which in turn is outwardly formed with a cylindrical part 40 and a second conical part 41 both arranged with an eccentricity E 2 related to its inner bore (not specified), i.e. to the parts 37 and 38 of the first ring 36.

The control cam 16 is formed with a mounting bore 42 corresponding to the cylindrical part 40 and the conical part 41 and including a cone 43. The control cam 16 is mounted by means of the front surface 32 of the flange 30, the first ring 36, the second ring 39, a washer 45 and a nut 44. As may be seen from FIG. 3, the rings 36 and 39 are formed with radial bores 46 and 47 respectively. According to FIGS. 3, 4 and 6 the vertical shaft 15 has an axis of rotation P whereas the physical axis of the control cam 16 is designated by R (FIGS. 4 and 6). According to FIG. 5, the rings 36, 39 are provided at their front surfaces 48, 49 with adjustment marks 50, 51 which cooperate with a further adjustment mark 52 of the control cam 16.

Figure 9:
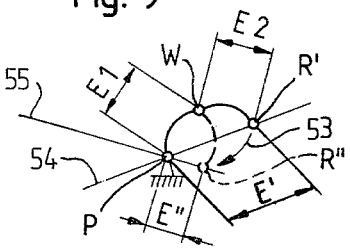
FIG. 9 is a symbolic illustration of the control cam adjustment device having two eccentrics.

Operation of the adjustment device 17 will be described in conjunction with FIGS. 6, 7, 8 and 9 as follows:

As may be seen from the symbolic illustration in FIG. 9, the effective eccentricity E' and E'' is achieved by respectively adjusting the rings 36 and 39, which are illustrated by their eccentricities E1 and E2 respectively. According to the designation of FIG. 4, the axis of rotation is marked by P, whereas the physical axis R of the control cam 16 is marked by R' or R'' respectively. In FIG. 9 it is illustrated how the angular position of the effective eccentricity may be altered by turning the rings 36 or 39. When turning the eccentricity E2 (i.e. the second ring 39) about the center of rotation W, the direction of the effective eccentricity changes from line 54 to line 55 as the effective eccentricity simultaneously alters from E' to E''.

Figure 7:
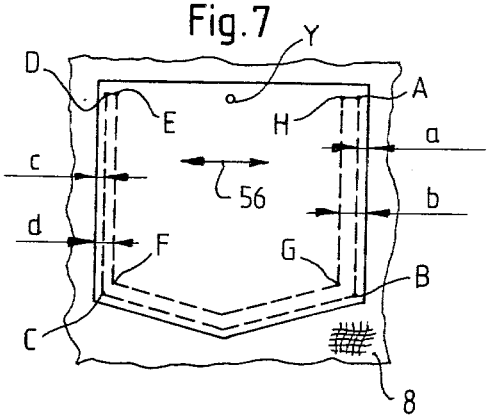
FIG. 7 shows a workpiece with a patch pocket attached by a double seam.

For the following description it may be assumed that the workpiece receiving device 7 is positioned as the needle 9 corresponds to a point A (FIG. 7). According to this position, the cam follower 25 (FIG. 1) cooperating with the groove 23 may be assumed as being positioned on a corresponding beam A (FIG. 6). The control cam 16 is illustrated with further beams which refer to the sewing position AB, CD, EF and GH. Due to the function of the clutch 18' the workpiece receiving device 7 is moved to and from a basic position Y, prior to a sewing operation.

As may be seen from FIGS. 1 and 7, a movement of the workpiece receiving device 7 in the direction of the sewing head 1, i.e. in direction of an arrow 56, is achieved by the cooperation of the groove 23 and the cam follower 25. In conjunction with FIGS. 1, 6 and 7, it may be noticed that a lateral displacement of the control cam 16 by an amount of the dimension E increases the effective distance between the groove 25 and the axis of rotation P of the cam sections AB or CD, while the effective distance between the groove 23 and the axis of rotation P decreases at the cam sections EF or GH. Due to the described displacement of the control cam 16, the dimension a of the sewing portion AB will be increased as the dimension b of the sewing portion GH decreases. Accordingly, an alteration is achieved at the sewing portions CD or EF, i.e. an increase of the dimension c and a decrease of the dimension d.

The described adjustment of displacing the control cam 16 leads to closer distances of the sewing portions AB to GH or CD or EF, whereas an oppositely directed adjustment of the control cam 16 changes the conditions and leads to wider distances of the mentioned sewing portions.

Figure 8:
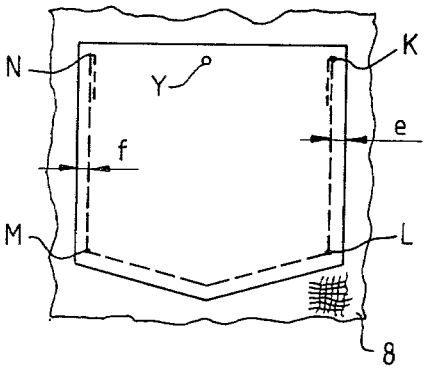
FIG. 8 shows a workpiece with a patch pocket attached by a single seam.

FIG. 8 shows a patch pocket attached to a workpiece 8 by means of a single stitch row having sewing portions designated as KL and MN which are symbolized in FIG. 6 accordingly. Similarly as described above, the lateral displacement of the control cam 16 by an amount of the dimension E increases the effective distance between the groove section KL and the axis of rotation P, whereas the effective distance between the groove section MN and the axis of rotation P decreases. Due to the relative position of the sections KL and MN the effects are altered in such a way, that both dimensions e and f are increased by an equal amount. Consequently, the conditions change to the opposite, i.e. decreased dimensions e and f are achieved, by an opposite lateral displacement of the control cam 16. As described, the novel adjustment device allows adjusting the distance of the stitch portions KL-MN of a single-stitch-row attached pocket, i.e. size adjustment of the inner pocket dimensions.

For setting the adjustment device (FIGS. 3 and 5), the nut 44 must be loosened prior to turning the rings 36 and 39, for which the radial bores 46 and 47 are usable with a hooked wrench. The adjustment marks 51 help finding once experienced setting. In FIG. 5 the rings 36 and 39 are shown in a position 17/16. The pin 33 shown in FIGS. 3 and 4 serves as a torque-transmitting-element and prevents the rings 36 and 39 from rotating as the conical parts 38 and 41 allow a mounting of the control cam 16 without any play.

What is claimed is:

1. A sewing machine for producing a stitch contour in a workpiece according to a predetermined program, comprising: stitch forming means including a needle;

a workpiece receiving device movably arranged with respect to said needle;

linkage means connected to said workpiece receiving device and having cam following means provided at said linkage means; and a control cam with a first axis cooperating with said cam following means and drivingly connected to said stitch forming means by transmitting elements including a shaft with a second axis adjustably receiving said control cam by a control cam adjustment device having a flange and a hub arranged on said shaft and comprising setting means arranged between said control cam and said shaft for allowing a lateral adjustment of said first axis in relation to said second axis.

2. A sewing machine for producing a stitch contour in a workpiece according to a predetermined program, comprising: stitch forming means including a needle;

a workpiece receiving device movably arranged with respect to said needle;

linkage means connected to said workpiece receiving device, including a first drive lever and a second drive lever, and cam following means arranged at each drive lever, said drive levers being pivoted at said sewing machine; and a control cam with a first axis pivoted at said sewing machine and cooperating with said drive levers by said cam following means and drivingly connected to said stitch forming means by transmitting elements including a shaft with a second axis adjustably receiving said control cam by a control cam adjustment device having a flange and a hub arranged on said shaft and comprising setting means arranged between said control cam and said shaft to allow a lateral adjustment of said first axis in relation to said second axis.

3. A sewing machine according to claim 2, wherein said setting means comprises:

a first ring turnably arranged on said hub and said flange and representing a first eccentric having a first eccentricity, a second ring turnably arranged on said first ring, said second ring representing a second eccentric having a second eccentricity and receiving said control cam by means of a bore, and fastener means arresting said rings and said control cam to form a firm connection with said shaft.

4. A sewing machine according to claim 3, wherein said first ring and said second ring each is formed with a corresponding first conical part, said second ring being formed outwardly with a second conical part, said bore of said cam being profiled with a cone corresponding to said second conical part.

5. A sewing machine according to claim 3, wherein said first ring, said second ring and said cam have adjustment marks.

6. A sewing machine according to claim 3, wherein said flange and said cam are positively connected by torque-transmitting means.

7. A sewing machine for producing an U-shaped stitch contour in a workpiece according to a predetermined program, comprising:

a frame;

a sewing head received by said frame and having stitch forming means including a needle;

a workpiece receiving device including an extending arm and movably arranged with respect to said needle;

linkage means having a first drive lever pivoted at said frame;

a second drive lever pivoted at said frame and linked to said extending arm, cam following means located at said drive levers, and a link drivingly connecting said extending arm with said first drive lever, said first drive lever and said second drive lever being operated about a rectangularly related basic position; and a control cam pivoted on said frame and having a first axis;

a bore and two control means cooperating with said drive levers by said cam following means, said control cam being drivingly connected to said stitch forming means by transmitting elements including a shaft with a second axis and adjustably receiving said control cam by an adjustment device having a flange and a hub arranged on said shaft, and having setting means arranged between said control cam and said shaft to allow a lateral adjustment of said first axis in relation to said second axis, said setting means comprising:

a first ring formed with an inner bore and an outer cylindrical part including a first conical part, on which outer parts are positioned with an eccentricity with respect to said bore, said first ring being turnably received on said hub and said flange by said inner bore, a second ring turnably arranged on said first ring, said second ring being formed with a bore corresponding to said outer parts of said first ring and being formed outwardly with a cylindrical part including a second conical part, both outer parts being positioned with said eccentricity relative to said bore of said second ring, said second ring receiving said cam in conjunction with said flange by said bore being formed as said outer parts of said second ring, adjustment marks located on said rings and said cam, fastener means arresting said rings and said cam to form a playfree connection with said shaft, and means for drivingly connecting said flange and said cam.

* * * * *